US007455558B2

(12) United States Patent
Yander

(10) Patent No.: US 7,455,558 B2
(45) Date of Patent: Nov. 25, 2008

(54) TROLLING MOTOR STEERING POSITIONER

(76) Inventor: Benny Yander, 36164 Klienpeter Rd., Prairieville, LA (US) 70769

( * ) Notice: Subject to any disclaimer, the term of this patent is extended or adjusted under 35 U.S.C. 154(b) by 0 days.

(21) Appl. No.: 11/307,694

(22) Filed: Feb. 17, 2006

(65) Prior Publication Data

US 2007/0197109 A1 Aug. 23, 2007

(51) Int. Cl.
*B63H 5/20* (2006.01)
*B63H 5/125* (2006.01)
*B63H 20/08* (2006.01)

(52) U.S. Cl. ..... 440/53; 440/63

(58) Field of Classification Search ..... 440/6, 440/53, 63
See application file for complete search history.

(56) References Cited

U.S. PATENT DOCUMENTS 3,315,631 A * 4/1967 Bass ..... 440/6
4,715,836 A * 12/1987 Schulte ..... 440/6
5,540,606 A * 7/1996 Strayhorn ..... 440/63
6,213,821 B1 * 4/2001 Bernloehr et al. ..... 440/6

* cited by examiner

*Primary Examiner*—Lars A Olson
*Assistant Examiner*—Daniel V Venne
(74) *Attorney, Agent, or Firm*—McGlinchey Stafford, PLLC

(57) ABSTRACT

Trolling Motor Steering Positioner: A trolling motor steering positioner (1) mounted on electric trolling motor shaft blocks (20) used on boats. The positioner (1) is made up of a tiller (12), which has a positioning pin attached to it and is attached to a circular disc (2) with holes (3) in it. The tiller (12) once located at any position on the circular disc (2) can then steer the trolling motor.

18 Claims, 1 Drawing Sheet

TROLLING MOTOR STEERING POSITIONER

BACKGROUND

1. Field of Invention

This invention relates to improving the steering mechanism for electric trolling motors used on boats.

2. Discussion of Prior Art

Electric trolling motors are used to position a fishing boat when a small quiet motor is desired over a boat's primary propulsion system. These trolling motors are usually operated while a game fisher is casting with a rod and reel. Power is applied utilizing either the controller on the trolling motor handle, which is provided by the factory, or by pre setting this controller and using a foot button switch to start and stop the motor as desired by the operator, enabling both hands to be free to cast and net the fish once caught. When the trolling motor is switched on, the propeller provides considerable thrust, which causes side loading of the single bushing on which the motor shaft allows the steering angle to rotate. Because the motor and propeller are located under the waterline, a long shaft is incorporated to provide a watertight conduit for power and allow for steering. Because of the high bushing load, it is difficult to make steering changes using prior art while the motor is running. This forces the operator to shut off the motor, adjust the steering angle, and turn the motor on with a foot switch, repeatedly. This is an awkward and inefficient process. Use of the trolling motor steering positioner is novel over prior art in that its main purpose is to provide greater leverage so that the operator can change the direction of the trolling motor while the motor is running and the propeller is turning, and that any angle of the steering handle is adjustable at any thrust level from any of 360 degrees in position.

An embodiment of the present invention comprises a steering positioner constructed of a circular disc with indexing holes and an alignment pin that provides adjustments of the steering handle 360 degrees. The movement of the steering handle from one hole to any other can be done with one hand without tools and the operator can move the steering handle position to match his or her position in the boat while keeping the original position of the motor stationary. The turning force of the steering handle is applied to the trolling motor shaft at the centerline making the turning force equal regardless of an operator's position. The steering positioner can be attached to most existing manual controlled trolling motors without the need to disassemble any of the manufacturers' parts. The steering positioner provides a higher mechanical advantage by incorporating a longer steering handle.

One exemplary embodiment of the present invention comprises a steering positioner apparatus for steering a boat propelled by a trolling motor. The apparatus comprises a circular disc forming a plurality of spaced-apart holes disposed around the perimeter portion of the circular disc. The apparatus further comprises a steering handle comprising a first end portion and a second end portion, the first end portion comprising an alignment pin being sized and configured to be received by any of the plurality of equally spaced-apart holes and a first bracket attached to the circular disc. The first end portion of the steering handle is attached to the first bracket in such a manner that the steering handle may pivot in a vertical and horizontal manner so that the steering handle may rotate in any degree of a 360 degree range of motion about a longitudinal axis of a shaft of the trolling motor and the alignment pin of the steering handle may be inserted into one of the plurality of equally spaced-apart holes, thereby allowing an operator of the boat to rotate the steering handle to cause the trolling motor shaft to rotate in a desired direction.

Another embodiment of the present invention comprises a method for facilitating the steering of a boat equipped with a trolling motor shaft. The method comprises affixing an apparatus to the trolling motor shaft, the apparatus comprising a circular disc forming a plurality of spaced-apart holes disposed around the perimeter portion of the circular disc. The apparatus further comprises a steering handle comprising a first end portion and a second end portion, the first end portion comprising an alignment pin being sized and configured to be received by any of the plurality of equally spaced-apart holes and a first bracket attached to the circular disc. The first end portion of the steering handle is attached to the first bracket in such a manner that the steering handle may pivot in a vertical and horizontal manner so that the steering handle may rotate in any degree of a 360 degree range of motion about a longitudinal axis of a shaft of the trolling motor and the alignment pin of the steering handle may be inserted into one of the plurality of equally spaced-apart holes, thereby allowing an operator of the boat to rotate the steering handle to cause the trolling motor shaft to rotate in a desired direction.

DRAWING FIGURES

The drawings show various aspects of the trolling motor steering positioner including the steering handle positioner assembly and the mounting bracket assembly.

Figures 1A, 1B:
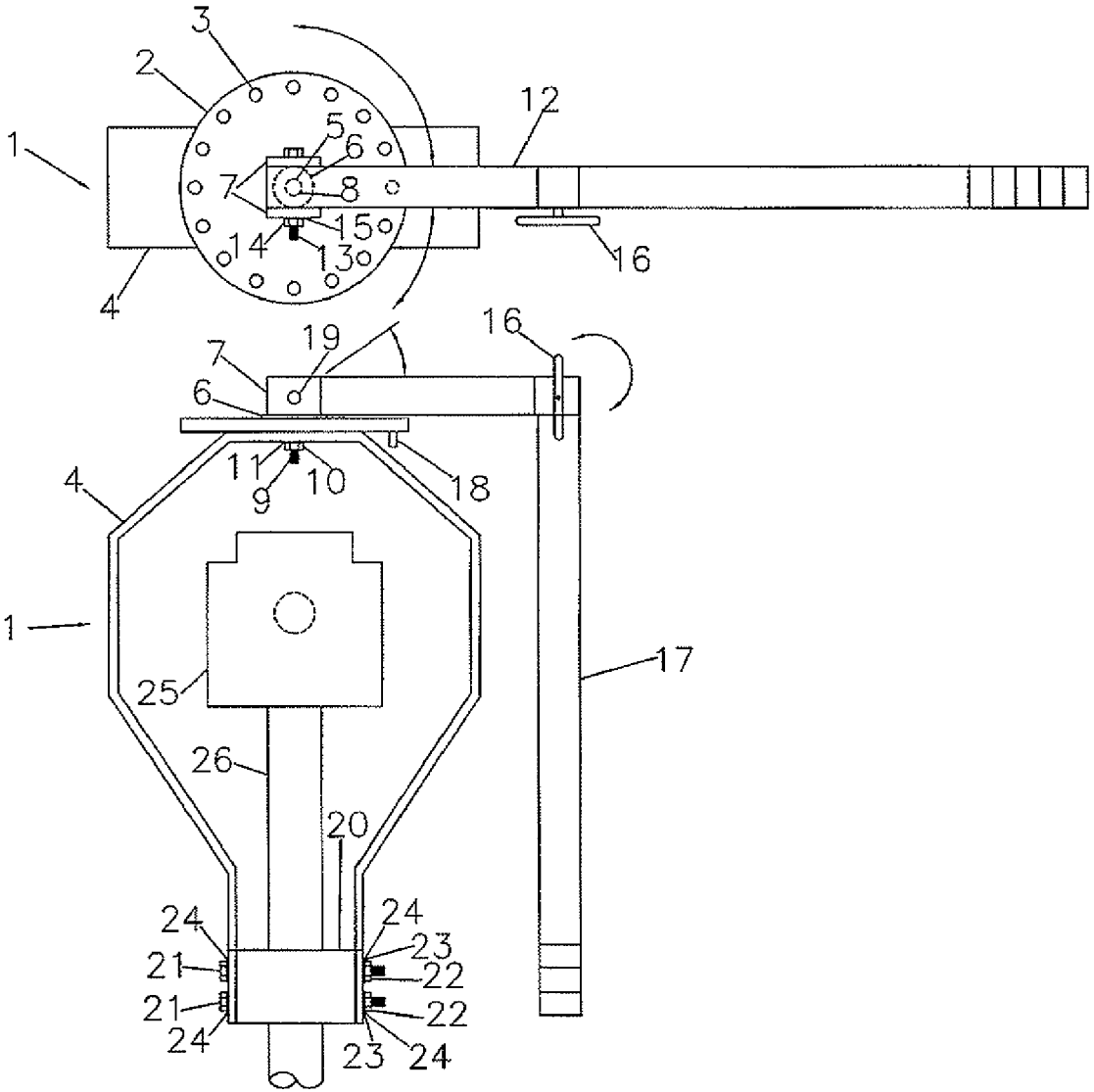
FIG. 1A is a top plan view of a steering handle positioner assembly consistent with one embodiment of the present invention.
FIG. 1B is a side view of a mounting bracket assembly in accordance with the embodiment of FIG. 1A.

REFERENCE NUMERALS IN DRAWINGS (1) Trolling motor steering positioner
(2) Circular Disc
(3) Indexing holes
(4) Mounting bracket
(5) Hole
(6) Low resistance washer
(7) C-channel bracket
(8) Hole
(9) Allen bolt
(10) Nut
(11) Washer
(12) Steering handle
(13) Bolt
(14) Nut
(15) Washer
(16) Swivel knob
(17) Adjustable handle
(18) Alignment pin
(19) Hole(s)
(20) Trolling motor shaft block
(21) Bolt(s)
(22) Nut(s)
(23) Washer(s)
(24) Hole(s)
(25) Trolling motor housing
(26) Trolling motor shaft

DETAILED DESCRIPTION OF THE DRAWINGS

FIGS. 1A-1B show a typical embodiment of the trolling motor steering positioner 1. FIG. 1A shows a top view of the trolling motor steering positioner 1. A circular disc 2 with indexing holes 3 drilled into it is welded on to the mounting bracket 4. A hole 5 is drilled into the middle of the circular disc 2. A low resistance washer 6 is placed between the circular disc 2 and a c-channel bracket 7, which has a hole 8 drilled through it. FIG. 1B shows how the c-channel bracket 7 is held in place by an allen bolt 9, nut 10, and washer 11. FIG. 1A also shows how the tiller 12 is placed into the c-channel bracket 7 and is held in place by bolt 13, nut 14, and washer 15. Also shown in FIG. 1A is how the tiller 12 can be folded with a swivel knob 16 and the length could be adjusted via an adjustable handle 17 (shown in FIG. 1B).

FIG. 1B is a rear view of the trolling motor steering positioner 1 with the tiller 12 positioned at a 90-degree angle to the right. An alignment pin 18 is shown, which is welded or fastened to the under side of the tiller 12. One can also see that the c-channel bracket 7 has holes 19 drilled into it through which bolt 13, nut 14, and washer 15 are placed. The mounting bracket 4 is attached to the trolling motor shaft block 20 with bolts 21 nuts 22 and washers 23 through holes 24. Also shown in FIG. 1B is how the mounting bracket 4 surrounds the trolling motor housing 25 and the trolling motor shaft 26.

Operation FIGS. 1A-1B

The manner of using the trolling motor steering positioner to steer a boat while under power of the trolling motor is much simpler and effective than current methods where the operator may need to turn off the trolling motor, adjust direction and then restart the motor. The operator turns on the trolling motor and uses the tiller to steer the boat in the desired direction. When the operator needs to move to another position in the boat, he or she simply lifts the tiller and moves it to the desired location, dropping the alignment pin in a new hole. From that position, the operator can then begin steering in any direction.

CONCLUSIONS, RAMIFICATIONS AND SCOPE

Accordingly, the reader will see that the trolling motor steering positioner of this invention can be used to steer a boat with great ease while the trolling motor is running. Although the description above contains many specificities, these should not be construed as limiting the design, colors or shapes of the invention but as merely providing illustrations of some of the presently preferred embodiments of this invention. For example, the bracket may have other shapes such as oval or square, etc. Thus the scope of the invention should be determined by the appended claims and their legal equivalents, rather than by the examples given above.

What is claimed is:

1. A steering positioner apparatus for steering a boat propelled by a trolling motor, the apparatus comprising a circular disc disposed above a control head of the trolling motor when the apparatus is installed, the circular disc further forming a plurality of spaced-apart holes disposed around the perimeter portion of the circular disc;

a tiller comprising a first end portion and a second end portion, the first end portion comprising an alignment pin being sized and configured to be received by any of the plurality of spaced-apart holes; and a first bracket attached to the circular disc;

whereby the first end portion of the tiller is attached to the first bracket in such a manner that the tiller may pivot in a vertical and horizontal manner so that the tiller may rotate in any degree of a 360 degree range of motion about a longitudinal axis of a trolling motor shaft and the alignment pin of the tiller may be inserted into one of the plurality of spaced-apart holes, thereby allowing an operator of the boat to rotate the tiller to cause the trolling motor shaft to rotate in a desired direction.

2. The steering positioner apparatus of claim 1 further comprising a mounting bracket forming a top surface, a first arm, and a second arm, the mounting bracket attached to the circular disc, the first arm detachably attached to a first side portion of a trolling motor shaft block and the second arm detachably attached to a second side portion of the trolling motor shaft block, the trolling motor shaft block being sized and configured for attachment to the trolling motor shaft so that, when the alignment pin is inserted into one of the plurality of spaced-apart holes, the operator of the boat may rotate the tiller to cause the trolling motor shaft block to rotate the trolling motor shaft in the desired direction.

3. The steering positioner apparatus of claim 2 wherein the tiller further comprises a swivel knob for swiveling the second end portion of the tiller relative to the first end portion of the tiller.

4. The steering positioner apparatus of claim 2 wherein the first bracket is a c-channel bracket.

5. The steering positioner apparatus of claim 1 wherein the tiller further comprises a swivel knob for swiveling the second end portion of the tiller relative to the first end portion of the tiller.

6. The steering positioner apparatus of claim 1 wherein the first bracket is a c-channel bracket.

7. The steering positioner apparatus of claim 1 wherein a length of the tiller is adjustable.

8. A method for facilitating the steering of a boat equipped with a trolling motor shaft, the method comprising affixing an apparatus according to claim 1 to the trolling motor shaft.

9. A method for facilitating the steering of a boat equipped with a trolling motor shaft, the method comprising affixing an apparatus according to claim 2 to the trolling motor shaft.

10. A steering positioner apparatus for steering a boat propelled by a trolling motor, the apparatus comprising a circular disc forming a plurality of spaced-apart holes disposed around the perimeter portion of the circular disc;

a tiller comprising a first end portion and a second end portion, the first end portion comprising an alignment pin being sized and configured to be received by any of the plurality of spaced-apart holes; and a first bracket attached to the circular disc;

whereby the first end portion of the tiller is attached to the first bracket in such a manner that the tiller may pivot in a vertical and horizontal manner so that the tiller may rotate in any degree of a 360 degree range of motion about a longitudinal axis of a trolling motor shaft and the tiller may further pivot about a horizontal axis, which horizontal axis is substantially perpendicular to the longitudinal axis, so that when the tiller is sufficiently pivoted about the horizontal axis, the alignment pin of the tiller is thereby inserted into and removably engaged with one of the plurality of spaced-apart holes, enabling an operator to rotate the tiller to cause the trolling motor shaft to rotate in a desired direction.

11. The steering positioner apparatus of claim 10 further comprising a mounting bracket forming a top surface, a first arm, and a second arm, the mounting bracket attached to the circular disc, the first arm detachably attached to a first side portion of a trolling motor shaft block and the second arm detachably attached to a second side portion of the trolling motor shaft block, the trolling motor shaft block being sized and configured for attachment to the trolling motor shaft so that, when the alignment pin is inserted into one of the plurality of spaced-apart holes, the operator of the boat may rotate the tiller to cause the trolling motor shaft block to rotate the trolling motor shaft in the desired direction.

12. The steering positioner apparatus of claim 11 wherein the tiller further comprises a swivel knob for swiveling the second end portion of the tiller relative to the first end portion of the tiller.

13. The steering positioner apparatus of claim 11 wherein the first bracket is a c-channel bracket.

14. The steering positioner apparatus of claim 10 wherein the tiller further comprises a swivel knob for swiveling the second end portion of the tiller relative to the first end portion of the tiller.

15. The steering positioner apparatus of claim 10 wherein the first bracket is a c-channel bracket.

16. The steering positioner apparatus of claim 10 wherein a length of the tiller is adjustable.

17. A method for facilitating the steering of a boat equipped with a trolling motor shaft, the method comprising affixing an apparatus according to claim 10 to the trolling motor shaft.

18. A method for facilitating the steering of a boat equipped with a trolling motor shaft, the method comprising affixing an apparatus according to claim 11 to the trolling motor shaft.

* * * * *